US007290467B2

(12) United States Patent
Harker

(10) Patent No.: US 7,290,467 B2
(45) Date of Patent: Nov. 6, 2007

(54) SOCKET WRENCH APPARATUS

(76) Inventor: Brian Harker, 14427 Windward Ct., Granger, IN (US) 46530

( * ) Notice: Subject to any disclaimer, the term of this patent is extended or adjusted under 35 U.S.C. 154(b) by 0 days.

(21) Appl. No.: 11/252,164

(22) Filed: Oct. 18, 2005

(65) Prior Publication Data

US 2007/0084314 A1 Apr. 19, 2007

(51) Int. Cl.
*B25B 13/06* (2006.01)
*B25B 13/10* (2006.01)
*B25B 13/02* (2006.01)

(52) U.S. Cl. ..... 81/125; 81/121.1

(58) Field of Classification Search ..... 81/125, 81/185, 13, 121.1
See application file for complete search history.

(56) References Cited

U.S. PATENT DOCUMENTS 3,834,253 A * 9/1974 Carr ..... 81/125
3,889,557 A * 6/1975 Young ..... 81/53.2
4,416,173 A * 11/1983 Rebish ..... 81/185
4,724,730 A * 2/1988 Mader et al. ..... 81/53.2
6,237,448 B1 * 5/2001 Haxton ..... 81/64
6,327,939 B1 * 12/2001 Macor ..... 81/125
2003/0110903 A1 * 6/2003 Creek ..... 81/125

* cited by examiner

*Primary Examiner*—David B Thomas
(74) *Attorney, Agent, or Firm*—Ryan M. Fountain

(57) ABSTRACT

A socket-wrench socket is provided having a plurality of longitudinally extending members therein mounted within wall circumferential slots of the workpiece-receiving opening of the socket and secured in place by a flexible web. These members have flat surfaces for engaging the workpiece and are biased into engagement with the workpiece by the web. These members and the slots are formed such that rotation of the socket causes the slots to exert radially inward camming force onto the members at the same time that rotational force is applied to the members. The members translate the camming force to flat surfaces of the workpiece for improved gripping, and translate rotational force to the workpiece for manipulation of the workpiece in the direction of that rotation.

11 Claims, 4 Drawing Sheets

SOCKET WRENCH APPARATUS

BACKGROUND AND SUMMARY OF THE INVENTION

The present invention relates generally to work piece holders and, more particularly, to socket-wrench sockets.

Prior socket-wrenches have employed interchangeable sockets for use with various sizes of nut and bolt heads. For example, if the bolt has a ½ inch head, a ½ inch size socket is selected. However, in order to allow the nut or bolt head to be easily inserted within and removed from the socket, the socket opening is typically made slightly larger than the nut or bolt head for a given size. In this way, the socket can also accommodate slight variations in manufacturing tolerances for a variety of nuts and bolts heads all of a given nominal size.

This sizing creates an inherent gap between the nut or bolt head and the socket opening. Unfortunately, that gap means that when the socket is rotated by the socket-wrench, it actually engages the nut or bolt head at a corner of the nut or bolt head, rather than at the actual flat sides of the nut or bolt head. Thus, the rotational forces exerted on the nut or bolt head by the socket can create localized stresses at the corners of the nut or bolt head. Since the socket is typically formed from harder material than the nut or bolt head, these localized stresses, especially over time and/or where the bolt or nut has become somewhat rusted, can actually deform the corners of the nut or bolt head. This deformation is typically referred to as "rounding" or stripping of the nut or bolt head.

In addition, over time nut and bolt heads made from certain materials can corrode, oxidize or rust. When that happens, the material of the nut or bolt head, especially at its surface, can become softer or more brittle. This can result in the nut or bolt head being more likely to deform when rotation by the socket is attempted, especially where the corrosion of nut or bolt has also caused it to become more tightly lodged in place. In extreme cases, the corrosion can result in sufficient enlargement of the nut or bolt head that the socket size originally used to install it becomes too small to fit the nut or bolt head.

Further, nuts and bolts are sometimes installed or removed from locations that are remote and/or difficult to access either because of distance from the socket-wrench drive handle and/or interference with nearby objects or because of counterboring settings or the like. Previously, sockets have employed magnets therein or magnetized portions to retain the nut or bolt heads within the socket for such remote uses. However, corrosion of the nut or bolt head can interfere with the use of such magnets, and not all nuts and bolts are formed from magnetic materials.

Various prior devices have been suggested for use with rounded and/or corroded nuts and bolt heads, especially where the nut or bolt is in place and needs to be removed. Some, for example, have suggested that the nut or bolt be sawed, as with a hack saw. Some have suggested that pound in splitters be used to destroy the nut or bolt for removal. Some have suggested that a pound in socket be used to partially cut into the nut or bolt head to engage and grip it deeply enough to allow standard socket-wrench removal. Each of these methods will in many cases work to remove the nut or bolt. However, where the nut or bolt is installed at a remote or difficult to access location, these methods have been unavailable.

As an alternative, it has also been suggested that special sockets could be used to grip the nut or bolt head, having either a collect or chuck-like gripping surface or a plurality of longitudinally extending pins or poles that serve to grip the nut or bolt head. In each case, these arrangements tend to require relatively complex and/or expensive assemblies. Also, the mechanical efficiencies of these constructions often are not ideal, some, for example, requiring translation of axial force to radial force for the initial gripping and some not necessarily gripping the nut or bolt head on a significant flat portion of their sides, with the resultant risks of localized stresses. Also, certain of these constructions require radial dimensions so large that they cannot access counterbored nuts or bolt heads. Further, certain of these arrangements, such as the use of multiple pins over the entire socket opening, require additional insertion force to retract the non-gripping pin members.

Similar problems in work piece manipulation can occur in other applications besides socket-wrenches. In general, the solutions proposed have suffered from the same sort of inefficiencies, expenses and practical disadvantages.

Accordingly, it is an object of the present invention to provide an improved method and apparatus for workpiece manipulation. Specific objectives of this invention include providing an apparatus which:

a. does not round or strip the workpiece corners,
b. facilitates manipulation of workpieces with rounded corners,
c. facilitates retention and placement of workpieces to remote or limited access locations,
d. requires limited tool changes to handle multiple different workpiece sizes,
e. provides efficient use of application force,
f. is relatively simple to construct, use and maintain, and
g. is relatively inexpensive to manufacture.

These and other objects of the present invention are attained by a socket-wrench socket having a plurality of longitudinally extending members therein mounted within wall circumferential slots of the workpiece-receiving opening of the socket and secured in place by a flexible web. These members have flat surfaces for engaging the workpiece and are biased into engagement with the workpiece by the web. These members and the slots are formed such that rotation of the socket causes the slots to exert radially inward camming force onto the members at the same time that rotational force is applied to the members. The members translate the camming force to flat surfaces of the workpiece for improved gripping, and translate rotational force to the workpiece for manipulation of the workpiece in the direction of that rotation.

Other objects, advantages and novel features of the present invention will be readily understood by those of ordinary skill in the art from the following detailed description and attached drawings.

BRIEF DESCRIPTION OF THE DRAWINGS

The various figures are not drawn to scale with respect to each other.

DETAILED DESCRIPTION OF PREFERRED EMBODIMENTS

Figure 1:
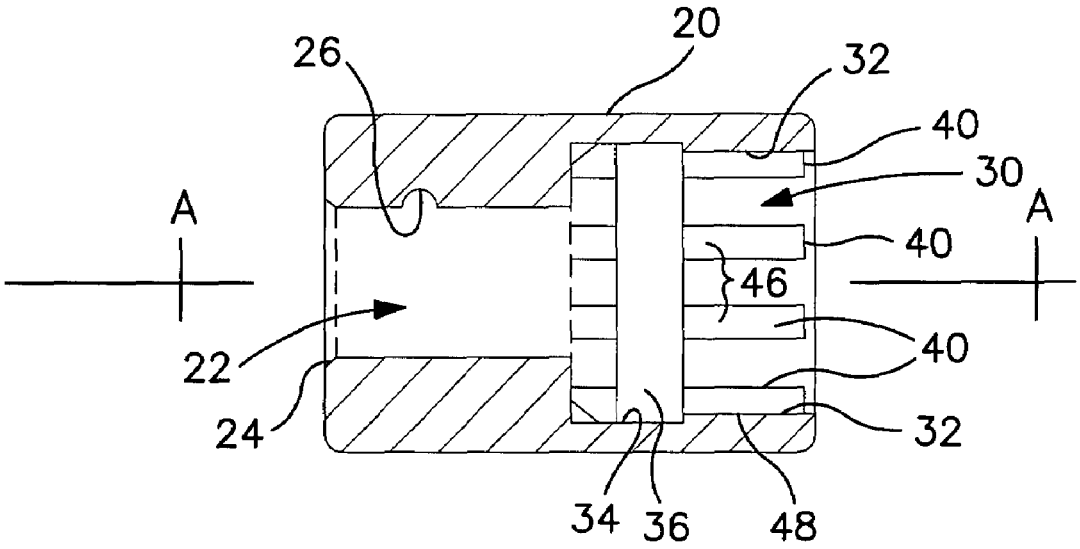
FIG. 1 shows a cross-sectional view of a socket-wrench socket embodying the present invention.
Figure 2:
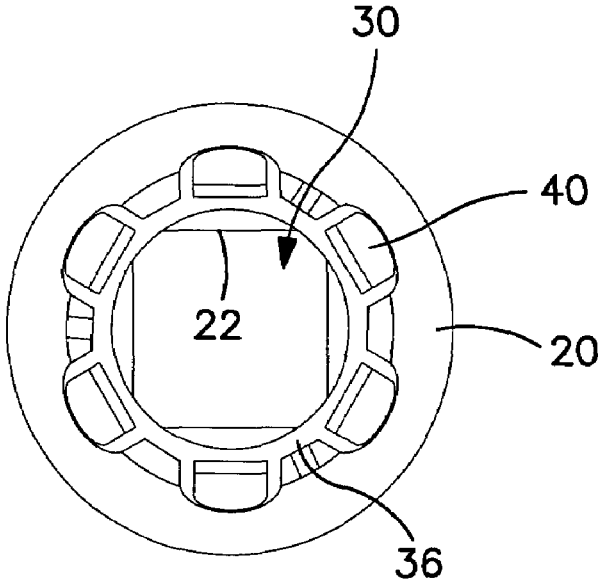
FIG. 2 shows a right end view of the socket of FIG. 1
Figure 4:
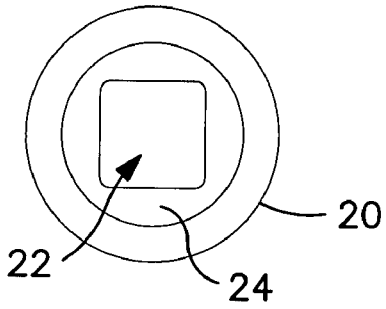
FIG. 4 shows a left end view of the sockets of FIGS. 1 and 3.
Figure 3:
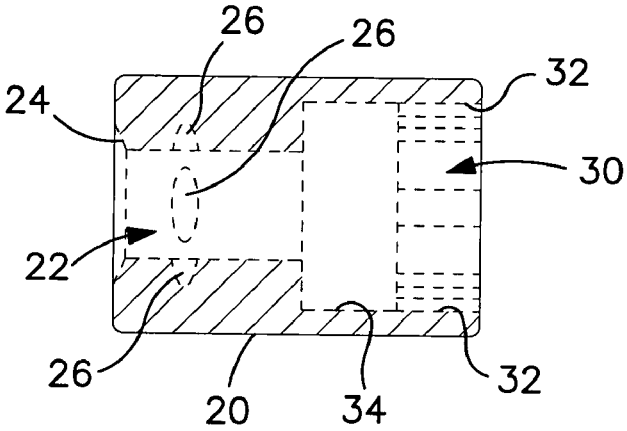
FIG. 3 shows a cross sectional view of the socket of FIG. 1 with the web and longitudinal members removed.
Figure 5:
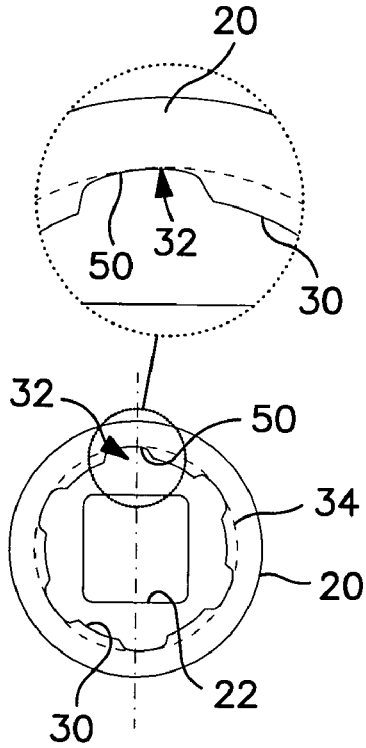
FIG. 5 shows a right end view of the socket of FIG. 4, with a portion of a slot enlarged.
Figure 7:
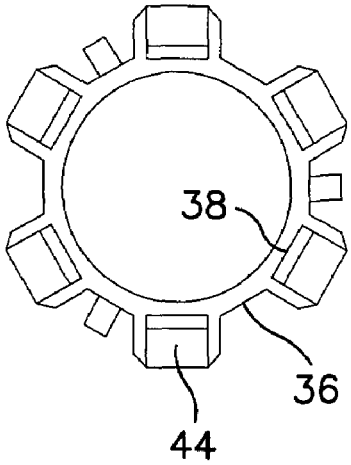
FIG. 7 shows a left end view of the combined web and longitudinal members of FIG. 6.
Figure 6:
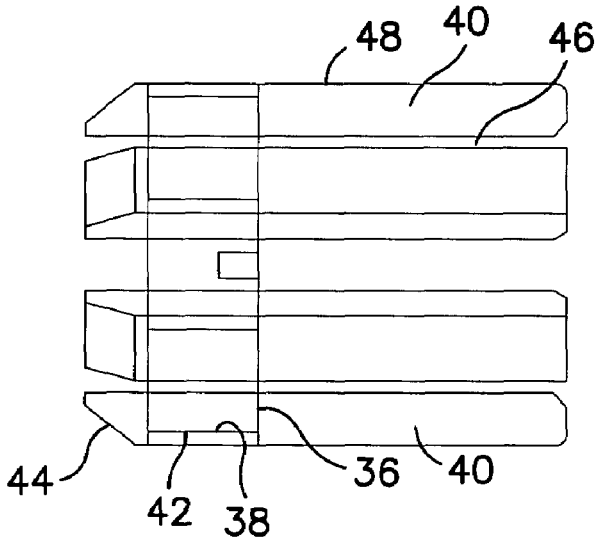
FIG. 6 shows an enlarged side view of the combined web and longitudinal members of FIG. 1.
Figure 8:
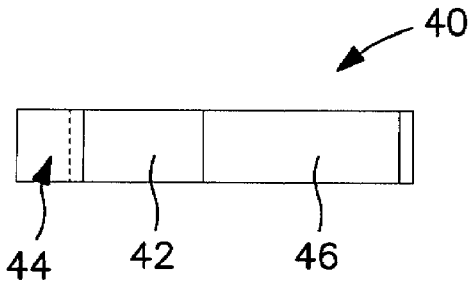
FIG. 8 shows a top view of the longitudinal member of FIG. 6.
Figure 9:
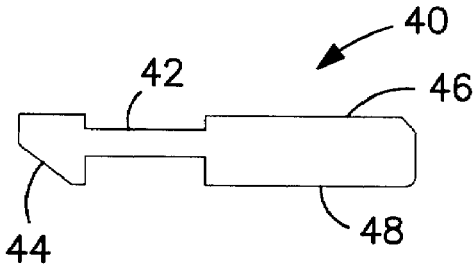
FIG. 9 shows a side view of the longitudinal member of FIG. 6.
Figure 10:
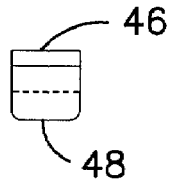
FIG. 10 shows a right end view of the longitudinal member of FIG. 6.
Figure 11:
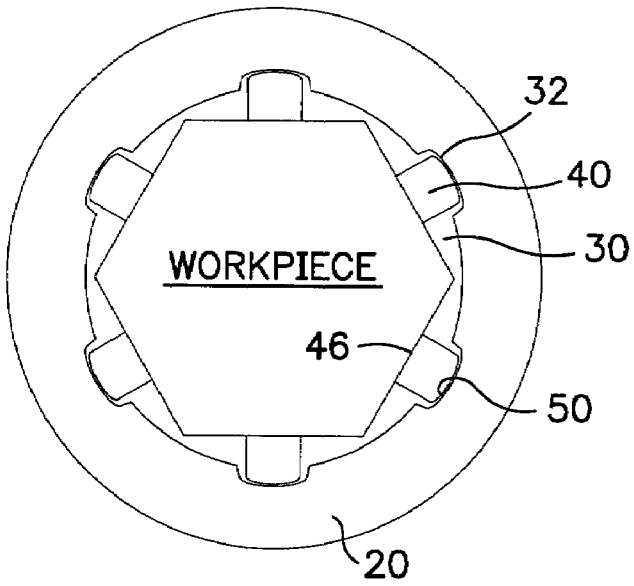
FIG. 11 shows an enlarged right end view of the socket of FIG. 1 with a workpiece received therein

FIG. 1 shows a preferred embodiment of the present invention for use as a socket 20 to be attached to a conventional socket-wrench (not shown). Socket 20 is, for example, formed from a high strength steel alloy and chromium plated, both in manners conventional to formation of socket-wrench sockets. Various sizes for these sockets can be selected as desired according to the size of the workpiece to be engaged an manipulated. Socket 20 has a longitudinal axis A.

Socket 20 includes an opening 22 at the left end of the socket housing for receiving the socket-wrench in a conventional manner. Sloping surface 24 is formed about opening 22 to facilitate insertion of the socket-wrench into the socket. Recesses 26 are formed within opening 22 to facilitate retention of the socket-wrench in the conventional manner.

Socket 20 includes an opening 30 at its right end for receiving a workpiece. Within opening 30 are a plurality of circumferential slots 32 and an enlargement area 34. A web 36 formed, for example, from noveon estane GP65DE Thermoplastic Elastomer, is provided and dimensioned so that it can compress upon insertion through opening 30 and expand into area 34, which restricts removal of web 36 from area 34 once so inserted. Web 36 includes a plurality of recesses 38. Longitudinally extending members 40 are provided formed, for example, from heat treated steel with a chromium plating. Web 36 is sufficiently elastic so as to deform slightly to receive members 40 and retain members 40 about reduced area 42. Once members 40 are inserted into web 36, the combination of those elements is inserted within opening 30, facilitated by sloping surface 44 of members 40, with each member 40 aligned with and within a corresponding slot 32.

Each member 40 preferably includes a flat surface 46 facing radially inward. These flat surfaces are disposed to engage the workpiece, preferably at a flat portion of the workpiece, once that workpiece is inserted within opening 30. Web 36 is dimensioned, for example, so that surfaces 46 are exactly at or slightly less than the size opening intended for the workpiece. Thus, web 36 can flex slightly to allow members 40 to move radially outward as the workpiece is inserted and maintain a slight biasing force on the workpiece once it is inserted. Thus, there is no gap between the workpiece and surface 46. Once socket 20 is rotated, the rotational forces are not shifted to a corner of the workpiece, but remain in the central area of the flats.

Each member 40 preferably includes a curved surface 48 facing and engagable with the inner surface 50 of corresponding slot 32. Surfaces 48 and 50 are, for example, dimensioned so that rotation of socket 20 in a given direction about axis A will cause relative movement of surfaces 48 and 50 to create a progressively increasing camming force to be applied by the socket to members 40. Preferably, surfaces 48 and 50 lack any engagable corners which would create localized camming force stresses between them when socket 20 applies rotational force to the workpiece.

Web 36 is sufficiently flexible to accommodate some variations in the workpiece size due to corrosion expansion, metric vs. standard sizing, and/or workpiece deformation due to prior insertion methods. Maintaining the biasing of members 40 into direct contact with the workpiece helps to prevent initial deformation of the workpiece as well as further deformation of already rounded or deformed workpieces. That biasing is also, preferably, sufficient in radial force to keep the workpiece within the socket as the workpiece is positioned at remote or limited access places.

While the present invention has been described above in regard to particular preferred embodiments, that is by way of illustration and example only and is not as a limitation of the invention. For example, while six longitudinal members have been shown in use, more or less can be employed in other embodiments according to the configuration of a given type of workpiece. Also, this form of workpiece manipulation can be used in machine tool holders and other workpiece engaging devices which apply force to the workpiece.

Accordingly, the spirit and scope of the present invention are limited only by the terms of the following claims, recitation of which is incorporated by reference in this specification.

What is claimed is:

1. A device for engaging and rotating elements having a non-round cross sectional end, comprising:

a housing portion having a first portion for receiving rotational force applied to the housing and a second portion for receiving an end of a rotatable element, the housing serving to transfer the rotational force applied to it toward the rotatable element, the second portion having:

at least one member with a flat surface portion for engaging the rotatable element, a means for biasing the flat surface radially inwardly when the rotatable element is inserted within the housing a camming surface engagable with the member when the housing receives rotational force for applying additional force to the flat surface in a radially inward direction.

2. The device according to claim 1 wherein the second portion further comprises a plurality of members with a flat portion for engaging the rotatable element, the plurality of members being arranged within the housing portion so as to be engagable with the rotatable element about the circumference of the end portion of the rotatable element when the rotatable element is inserted within the housing portion.

3. The device according to claim 2 wherein the members are mounted in a flexible web that generally retains the position of individual members relative to each other, and retains the members within the housing portion, and provides radially inward biasing force to the flat surface when the rotatable element is inserted within the housing member.

4. The device according to claim 3 wherein the housing portion includes an interior slot for receiving each of the members and the configuration of each slot is arranged with respect to the surface of the corresponding member such that rotation of the slot relative to its corresponding member causes surface engagement between the slot and that member which exerts the additional force to the flat surface in a radially inward manner in response to rotational force in a given direction being applied to the housing portion.

5. A socket-wrench socket for engaging nuts or bolts or the like, comprising:

a housing of a given longitudinal length with a first portion connectable to a conventional socket-wrench and a second portion for receiving a portion of a nut or bolt, the second portion having an opening therein sized to receive a nut or bolt having a given range of sizes and cross sectional shapes, the opening having a radially interior wall, a plurality of members extending along a longitudinal portion of the housing and disposed within the opening and adjacent the radially interior wall, a web for engaging each of the members and biasing them toward a given position relative to each other and relative to the radially interior wall, the web being engagable with the radially interior wall for retaining the members within the opening, the opening including a plurality of slotted portions along the radially interior wall, each of which for receiving one of the members and having a surface engagable with a portion of its corresponding member, and the radial cross section of the surface of each slotted portion which is engagable with its corresponding member being of a configuration which permits the slotted portion to apply by camming surface action a progressively increasing radially inward force to its corresponding member as rotation of the housing progresses through an arc in a given direction.

6. The socket according to claim 5 wherein at least one of the members includes a flat surface portion on its radially inward side along at least one end of the member.

7. The socket according to claim 6 wherein the web is disposed intermediate the ends of the members.

8. The socket according to claim 7 wherein the opening includes a recess for receiving and retaining therein the web.

9. The socket according to claim 5 wherein each of the slotted portions extends along at least the length of its corresponding member.

10. The socket according to claim 5 wherein the members have substantially the same longitudinal length.

11. An apparatus for removing stripped, partially rounded or rusted nuts, bolts and the like, comprising a socket for receiving therein the head of the nut, bolt or the like, means for applying retention force to the nut, bolt or the like once it is inserted within the socket, and means for engaging the nut, bolt or the like over a flat surface portion thereof with a flat surface portion of the socket when the socket is rotated.

* * * * *